United States Patent [19]

Heinzle

[11] 3,966,376

[45] June 29, 1976

[54] SLIP FORM ARRANGEMENT FOR CONSTRUCTING ANNULAR STRUCTURES

[76] Inventor: Otto Heinzle, Sonderberg 19, 6840 Gotzis (Vorarlberg), Austria

[22] Filed: Feb. 18, 1975

[21] Appl. No.: 550,835

Related U.S. Application Data

[63] Continuation-in-part of Ser. No. 405,880, Oct. 12, 1973, Pat. No. 3,897,182.

[30] Foreign Application Priority Data

Oct. 13, 1972 Austria ..... 8812/72
Feb. 19, 1974 Austria ..... 1341/74

[52] U.S. Cl. ..... 425/63; 249/20
[51] Int. Cl.[2] ..... E04G 11/22
[58] Field of Search ..... 249/1, 17, 20, 22; 425/63–65; 264/33–34; 52/246, 248

[56] References Cited

UNITED STATES PATENTS

| | | | |
|---|---|---|---|
| 3,045,313 | 7/1962 | Dorn | 249/17 |
| 3,509,606 | 5/1970 | Fisher | 425/63 |
| 3,510,098 | 5/1970 | Fox | 425/63 |
| 3,516,129 | 6/1970 | Yoder | 425/64 |
| 3,521,335 | 7/1970 | Heinzle | 425/63 |

*Primary Examiner*—Francis S. Husar
*Assistant Examiner*—John McQuade
*Attorney, Agent, or Firm*—Hans Berman

[57] ABSTRACT

The upright annular concrete wall of a silo, swimming pool, or like structure of large diameter is poured in a slip form suspended from three columns for best stability of the slip form arrangement. A work platform is mounted on beams which radially connect the form with a coaxial, inner, annular frame. Carriers are interposed between the columns and the frame in such a manner that six approximately equally distributed circumferential portions of the frame are connected to the columns, so that the unsupported spans of the frame between connections to the carriers are only one half of what they would be if the frame were directly attached to the columns.

15 Claims, 8 Drawing Figures

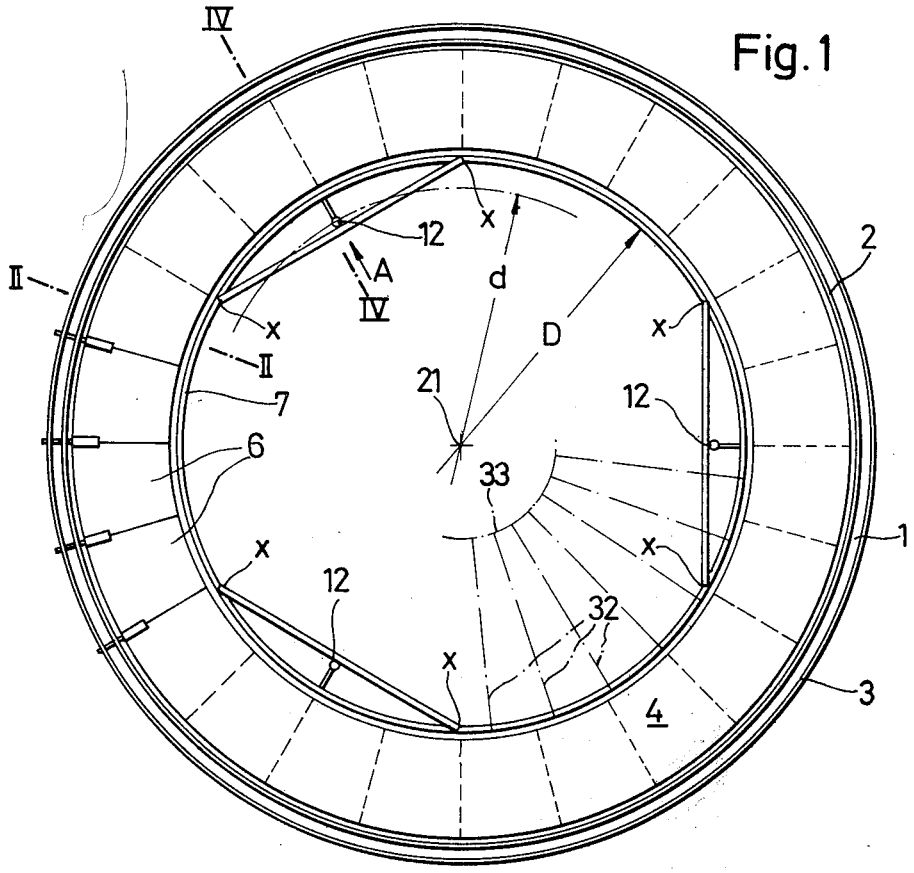
Fig.1
Fig.7
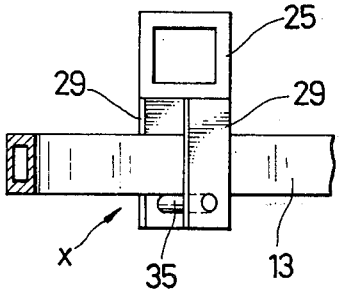
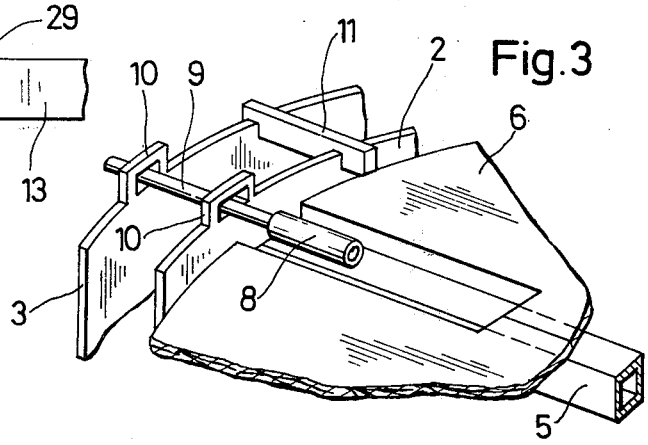
Fig.3

12
18
23
22
36
16
26
27
24
13
2
7
28
4
15
30
31
14
25
29
x
VI
20
19
17
37
3

SLIP FORM ARRANGEMENT FOR CONSTRUCTING ANNULAR STRUCTURES

This application is a continuation-in-part of the copending application Ser. No. 405,880, filed on Oct. 12, 1973, now U.S. Pat. No. 3,897,182.

This invention relates to slip forms for constructing annular structures, and particularly to improvements in the apparatus disclosed and claimed in the afore-mentioned copending application.

As has been shown in the earlier application, the annular, upright wall of a silo, swimming pool or other structure of large horizontal dimensions may advantageously be constructed from concrete poured in a slip form which is suspended from three upright columns located approximately at the corners of an equilateral horizontal triangle. Three columns lend better stability to the slip form arrangement than can be had with more or fewer columns.

An annular frame extending in a surface transverse to the column is attached in the known apparatus to respective slides mounted on the columns. Beams radiating outward from the frame may support a work platform, and the inner and outer walls of the form are suspended from the outer, free ends of the beams, and may be raised and lowered by shifting the slides on the columns. While this apparatus has been used successfully in many instances, it becomes bulky when the horizontal dimensions of the wall to be constructed exceed approximately 15 meters. The unsupported spans of the annular frame between the slides become so long that the frame must be made very heavy and correspondingly difficult to handle. It would not be desirable to shorten the spans by providing more than three columns.

It has now been found that the number of the columns need not be increased, yet the free spans of the annular frame may be shortened by providing an intermediate carrier arrangement operatively interposed between the slides and the frame and including a plurality of fastening devices engaging respective circumferential portions of the frame, the portions being circumferentially spaced from each other, and the number of the engaged portions and of the engaging fastening devices being greater than the numer of the columns. The invention will be described hereinbelow with reference to a slip form arrangement of relatively modest dimensions in which the carrier arrangement engages six spaced portions of the annular frame, but this number may be increased depending on specific conditions, the number of fastening devices and engaged frame portion preferably being $2^n$ times the number of columns, wherein $n$ is an integer not less than 1.

Other features, additional objects, and many of the attendant advantages of this invention will readily be appreciated from the following detailed description of a preferred embodiment when considered in connection with the appended drawing in which:

FIG. 1 shows a slip form arrangement of the invention in simplified top plan view;

FIG. 3 is a fragmentary perspective view of the device of FIG. 2;

FIG. 7 is an enlarged view of one of the junctions $x$ indicated in FIG. 1; and

Figure 8:
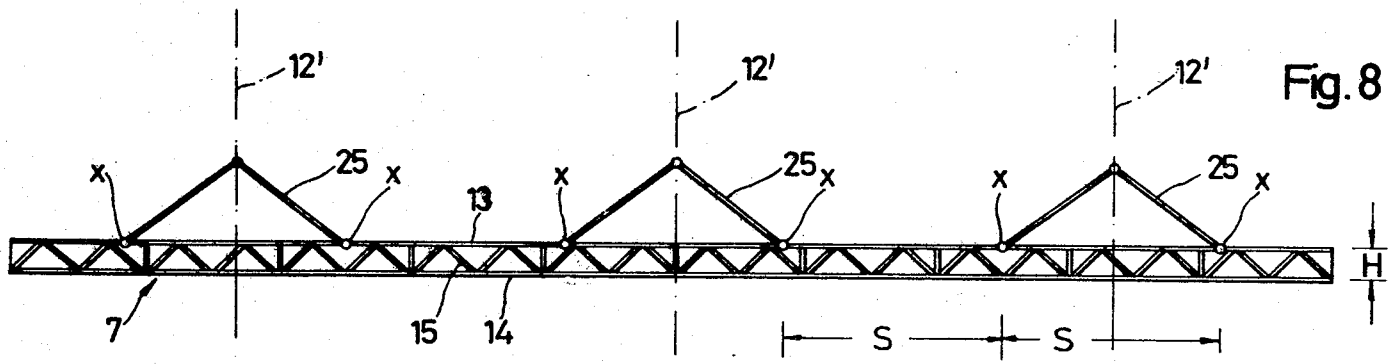
FIG. 8 is a developed, simplified view of an annular frame in the apparatus of FIG. 1 with some dimensional relationships drawn to scale.

Referring now to the drawing in detail, FIG. 1 shows a slip form arrangement for building a circular concrete wall 1 between the outer cylindrical wall 3 and the inner cylindrical wall 2 of a slip form, the two walls having a common, upright axis 21. An annular work platform 4 extends radially inward from the wall 2 toward an annular frame 7, the load bearing surface of the platform being formed by sectional plates or panels 6.

The weight of the slip form of the platform 4 and of the frame 7 is transmitted to a small extent to the finished bottom portion of the wall 1, but is mainly carried by three tubular columns 12 equiangularly spaced along a circle about the axis 21 whose diameter $d$ is smaller than the inner diameter D of the frame 7. The columns thus define a triangle about the axis 21 in a plane perpendicular to the axis. As is shown in FIG. 1 by chain-dotted lines, the frame 7 may be reinforced by supplemental beams 32 radially connecting the frame 7 to an inner, coaxial ring 33 in a manner more fully described in the afore-mentioned earlier application. The frame 7 is fastened to the three columns 12 at six junctions $x$ spaced approximately 60° apart along the inner circumference of the frame 7, as will presently be described in more detail.

Figure 2:
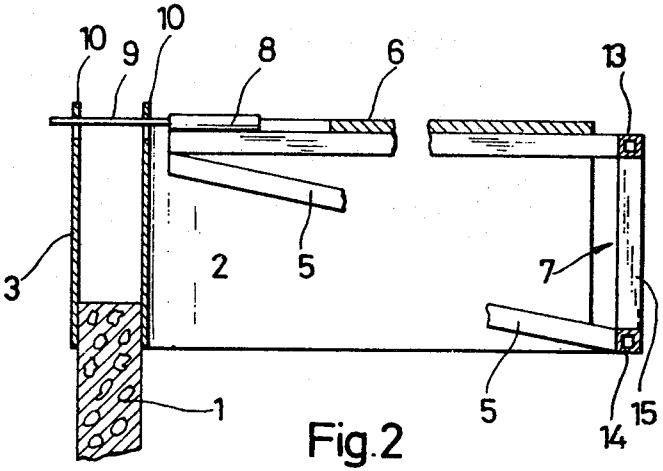
FIG. 2 shows a portion of the apparatus of FIG. 1 in elevational section on the line II — II.

As is shown in FIGS. 2 and 3, and disclosed in more detail in the earlier application, the sectional plates 6 are mounted on lattice beams 5 consisting of square tubes and having one end portion releasably attached to the frame 7. The beams extend substantially horizontally and outwardly away from the frame 7, and the walls 2, 3 are releasably secured to the outer longitudinal end portions of the beams 5. Rods 9 are radially slidable in sleeves 8 welded to the outer beam ends and engage apertured lugs 10 on the top edges of the depending walls 2, 3. The edges are held at a desired radial distance by notched spacers 11. The frame 7 consists of releasably assembled lattice girder sections having each an upper chord 13, a lower chord 14, and connecting struts 15.

Figures 4, 5:
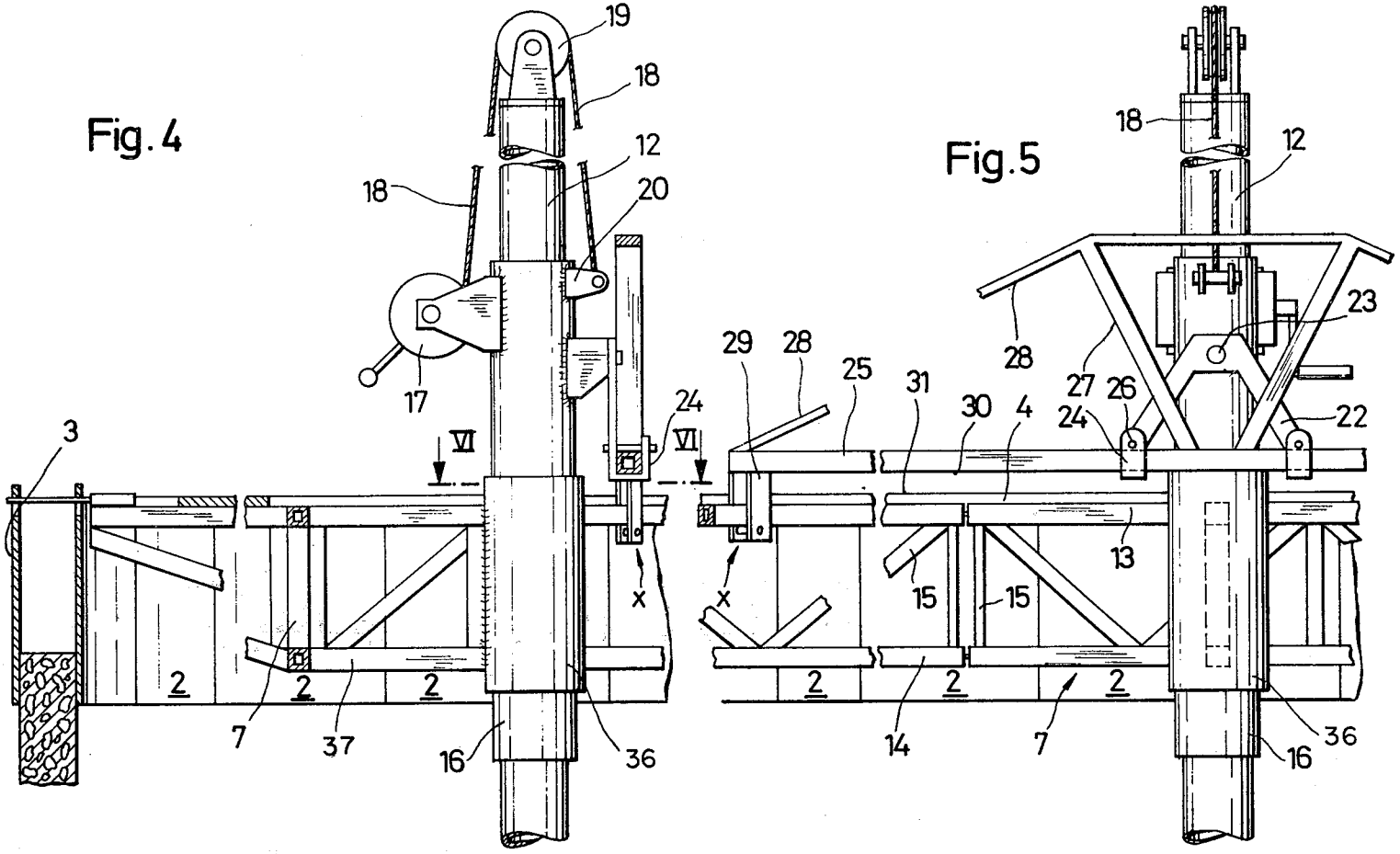
FIG. 4 illustrates the apparatus of FIG. 1 in elevational section on the line IV — IV.
FIG. 5 shows the device of FIG. 4 in an elevational view taken in the direction of the arrow A in FIG. 1.

This is better seen in FIG. 5 which, jointly with FIG. 4, shows a tubular slide 16 coaxially mounted on each column 12. The slide may be raised or lowered by means of a manually operated winch 17. One end of a cable 18 is wound on the winch, and the cable passes over a pulley 19 on the top of the column 12 to a fastening bracket 20 on the slide 16. A pawl-and-ratchet arrangement, not explicitly shown, permits the winch to be blocked in any desired vertical position of the slide 16, as is conventional in itself. The blocking device may be released manually if so desired.

The central or apex portion of a bracket 22 having the shape of an inverted V is attached to the radially inner face of the slide 16 by a heavy pivot pin 23. The free lower ends 24 of the two bracket branches are bent over on themselves to provide receptacles for a slidably received, horizontal, straight carrier bar 25 secured in a vertical direction in each receptacle by a releasable pin 26. The bar 25 constitutes the bottom chord of a girder which also includes compression members 27 and tension members 28 arranged above the bar 25 and reinforcing the bar. While the central portion of each carrier bar 25 is fastened to a slide 16 by a bracket 22, the two terminal portions of the bar carry hangers constituted by two parallel, spacedly depending lugs 29 and a pin 35 connecting the lugs, as is shown in FIG. 7. The upper chord 13 of the frame 7 passes through the openings in the several hangers which are provided at each of the junctions *x* shown in FIG. 1.

Figure 6:
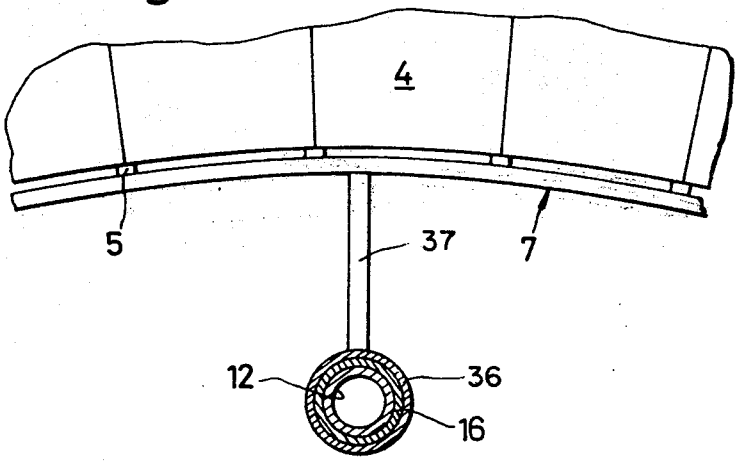
FIG. 6 shows a portion of the apparatus of FIG. 1 on a larger scale and partly in plan section on the line VI — VI in FIG. 4.

As is evident from FIGS. 4 and 6, a cylindrical sleeve 36 coaxially envelopes a portion of each slide 16 and is freely movable on the associated slide. Spacer beams 37 are welded to the sleeve and extend radially outward to the frame 7 to which they are fastened, thereby centering the frame 7 in the axis 21 without exerting axial stresses on the slides 16 or the columns 12.

FIG. 8 shows representative dimensional relationships of the frame 7 and of associated elements. The illustrated slip form arrangement is used in the construction of a wall 1 having a diameter of about 16 meters, and the frame 7 has a circumferential length of about 44 meters divided into unsupported spans *s* of about 7 meters by the six junctions *x* at the ends of the three carrier bar assemblies 25. The illustrated frame 7 has a height H of about 1 meter.

For building a very much larger circular or otherwise annular wall, the length of each carrier bar 25 may be increased suitably, a bracket 22 mounted on the two ends of the lengthened bar, and each bracket connected to respective circumferential portions of a large frame otherwise analogous to the frame 7 by the two ends of an elongated supplemental carrier member mounted on each bracket in a manner obvious from FIGS. 4 and 5. In the resulting structure, the annular frame is supported in 12 points, and it may be supported in 24 points by further interposition of brackets and carrier bars between the columns 12 and the annular frame, each set of brackets and carrier bars increasing the number of fastening points for the annular frame by a factor of two.

The elements of the illustrated apparatus may be disassembled with simple tools for transportation to another building site and assembled there again with additional elements for the construction of a larger concrete wall which may require the reinforcement of the frame 7 by the supplemental beams 32 and the inner ring 33 shown in FIG. 1. To facilitate the attaching of the beams 32 to the frame 7, the bottom face 30 of each carrier bar 25 is upwardly spaced from the top face 31 of the upper chord 13 of the frame 7, as is shown in FIG. 5.

While the invention has been described with reference to apparatus for constructing a concrete wall that extends in a closed circle about the axis 21, walls which form an open ring are built conveniently with the illustrated apparatus by means of a suitably modified slip form. The wall, whether extending in a closed loop about the columns or in a partial loop, may be of circular, elliptic, polygonal or any other desired shape without requiring basic modifications of the form arrangement.

The carrier system interposed between the columns 12 and the frame 7 permits a substantial reduction in the weight of the frame which is most important in the building of very large structures, but is of advantage even with smaller structures, such as those having diameters of less than 15 meters.

Manually operated winches have been found adequate in most cases, but may be replaced by electrically operated hoists or other lifting devices for the slides 16 in an obvious manner.

It should be understood, therefore, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

What is claimed is:

1. A slip form arrangement for pouring a concrete mixture comprising:

a. three upright columns;

b. a slide member mounted on each column for vertical movement;

c. an annular frame extending about an upright axis in a surface transverse to said columns, 1. said columns defining a triangle about said axis in a plane perpendicular to said axis;

d. carrier means connecting said slide members and said frame and including a plurality of fastening means engaging respective circumferential portions of said frame, 1. said portions being circumferentially spaced from each other, 2. the number of said portions and of said fastening means being greater than the number of said columns;

f. a plurality of elongated beam members;

g. attaching means one longitudinal end portion of each beam member to said frame in a position in which the direction of elongation of each beam member is substantially horizontal and outwardly away from said frame;

h. an annular form assembly including an outer form wall and an inner form wall respectively remote from and near said frame and spaced from each other in said direction, said form assembly enveloping said columns;

i. securing means releasably securing respective portions of each of said walls to the other longitudinal end portions of said beam members, the secured walls depending from said beam members and holding said other end portions in transversely spaced relationship; and j. means operatively interposed between said slide members and said upright columns for holding said slide members in predetermined vertical positions on said upright columns and for thereby transmitting a portion of the weight of said frame and of said form assembly to each of said columns.

2. An arrangement as set forth in claim 1, wherein the number of said portions is $2^n$ times the number of said columns, *n* being an integer not less than 1.

3. An arrangement as set forth in claim 2, wherein said form assembly extends in a circle about an upright axis, said columns and said fastening means being distributed approximately equiangularly about said axis.

4. An arrangement as set forth in claim 1, wherein said carrier means include a carrier member mounted on each of said slide members and having two end portions horizontally spaced from each other and from the associated slide member, each end portion carrying one of said fastening means.

5. An arrangement as set forth in claim 4, wherein said fastening means each include a hanger depending from the end portion carrying said fastening means.

6. An arrangement as set forth in claim 5, wherein said hanger defines a horizontal passage, said frame including an elongated frame member extending longitudinally through said passage.

7. An arrangement as set forth in claim 4, wherein said carrier means further include a plurality of forked brackets having respective central portions secured to said slide members, each bracket having two branches diverging downward from said central portion and engaging a portion of an associated carrier member intermediate said end portions of the carrier member.

8. An arrangement as set forth in claim 7, wherein each bracket projects from the associated slide member toward the associated carrier member in a direction inwardly away from said frame.

9. An arrangement as set forth in claim 7, wherein said branches slidably engage said associated carrier member.

10. An arrangement as set forth in claim 4, wherein said carrier means further include reinforcing means for increasing the rigidity of said carrier member, said reinforcing means including a plurality of compression members and of tension members connected to each other and to said carrier member jointly to constitute a lattice girder.

11. An arrangement as set forth in claim 10, wherein said carrier member constitutes the lower chord of said lattice girder.

12. An arrangement as set forth in claim 4, further comprising plate means superimposed on said beam members and forming a horizontally extending platform, said carrier members being upwardly spaced from said platform.

13. An arrangement as set forth in claim 1, further comprising spacer means operatively interposed between said columns and said frame for maintaining a predetermined distance between each of said columns and said frame.

14. An arrangement as set forth in claim 13, wherein each spacer means include an annular member secured to one of said columns for free upright movement, and a connecting member having two end portions respectively fastened to said annular member and to said frame.

15. An arrangement as set forth in claim 1, wherein said frame member envelopes said columns.

* * * * *